US005193770A

United States Patent [19]

Kildare

[11] Patent Number: 5,193,770

[45] Date of Patent: Mar. 16, 1993

[54] BAG HOLDER

[76] Inventor: David N. Kildare, R.R. #2 - Site 13, Comp. 14, Westbank, British Columbia, Canada, V0H 2A0

[21] Appl. No.: 857,115

[22] Filed: Mar. 19, 1992

Related U.S. Application Data

[62] Division of Ser. No. 667,322, Mar. 11, 1991, abandoned.

[30] Foreign Application Priority Data

Mar. 8, 1990 [CA] Canada ..... 2016971

[51] Int. Cl.[5] ..... A63B 55/04

[52] U.S. Cl. ..... 248/97; 248/101; 292/256.69

[58] Field of Search ..... 248/97, 101, 95, 99; 292/257, 256.65, 256.69

[56] References Cited

U.S. PATENT DOCUMENTS

| | | | |
|---|---|---|---|
| 754,580 | 3/1904 | Madden | 248/101 X |
| 1,129,911 | 3/1915 | Smith et al. | 248/101 X |
| 1,254,371 | 1/1918 | Smith | 248/101 |
| 1,362,517 | 12/1920 | Stuart | 248/101 X |
| 2,101,813 | 12/1937 | Lockhart | 299/256.69 |
| 4,376,520 | 3/1983 | Wetherington | 248/97 |
| 4,684,087 | 8/1987 | Spickard | 248/97 |

*Primary Examiner*—Alvin C. Chin-Shue
*Attorney, Agent, or Firm*—George A. Seaby

[57] ABSTRACT

A relatively simple, collapsible garbage bag holder of the type for use outdoors includes an annular frame with a outer peripheral groove therein for receiving a split ring, which is used to releasably retain the top end of a garbage bag on the frame, legs releasably connected to the frame for holding the latter above the ground, a pair of handles on the free ends of the split ring for rotating the ring around a hinge on the opposite side of the frame between an open bag receiving position and a closed position, and a triangular latching lever rotatably mounted on one handle with a arcuate slot therein for slidably receiving the other handle, whereby when the lever is rotated the handles are drawn together to tighten the ring against the bag and into the groove.

3 Claims, 5 Drawing Sheets

BAG HOLDER

This is a divisional of application Ser. No. 667,322 filed Mar. 11, 1991 now abandoned.

BACKGROUND OF THE INVENTION

1. Field of the Invention

This invention relates to a bag holder, and in particular to a collapsible, portable holder for flexible plastic bags.

2. Discussion of the Prior Art

Bag holders of generally the type proposed herein are by no means new. Examples of such bag holders are described in U.S. Pat. Nos. 1,439,878, issued to R. W. Erhardt et al on Dec. 26, 1922; 1,664,658, issued to C. P. Blazer on Apr. 3, 1928; 3,468,505, issued to W. J. Reilly on Sep. 23, 1969; 3,563,505, issued to W. B. Langley on Feb. 16, 1971; 3,771,752, issued to R. F. Meeh on Nov. 13, 1973; 4,157,801, issued to R. L. Elmer on Jun. 12, 1979; 4,488,697, issued to N. G. Garvey on Dec. 18, 1984 and 4,630,752, issued to R. A. DeMars on Dec. 23, 1986.

In general terms, while the patented devices perform the desired function, such devices either are not portable or are somewhat complicated and thus expensive to produce. Moreover, a common problem with portable bag holders is that of tightly clamping the bag in the open position in the holder.

GENERAL DESCRIPTION OF THE INVENTION

The object of the present invention is to solve the above problem by providing a relatively simple, portable bag holder with a readily closable and releasable latch.

Accordingly, the present invention relates to holder for a flexible bag comprising annular frame means; for supporting the top end of the bag; leg means for holding said frame means in an elevated position; split ring means; hinge means pivotally connecting the middle of said ring means to said frame means; handle means extending outwardly from each free end of said ring means for facilitating manual rotation of the ring means around the plane of said frame means between an open position in which only the centre of said ring means overlaps one side of the frame means, and a closed position in which the entire ring means overlaps the peripheral outer side edge of said frame means; and first latch means pivotally connected to one said handle means for rotation around said one handle means into releasable locking engagement with the other said handle means, whereby, with the ring means in the open position, when a bag is placed in said frame means and the top of the bag is folded over the frame means, the ring means can be rotated to the closed position to engage the top of the bag around substantially the entire periphery of said frame means, and the first latch means rotated to lock the ring means in the closed position.

BRIEF DESCRIPTION OF THE DRAWINGS

The invention will be described in greater detail with reference to the accompanying drawings, which illustrate preferred embodiments of the invention, and wherein.

DESCRIPTION OF PREFERRED EMBODIMENT

Figure 1:
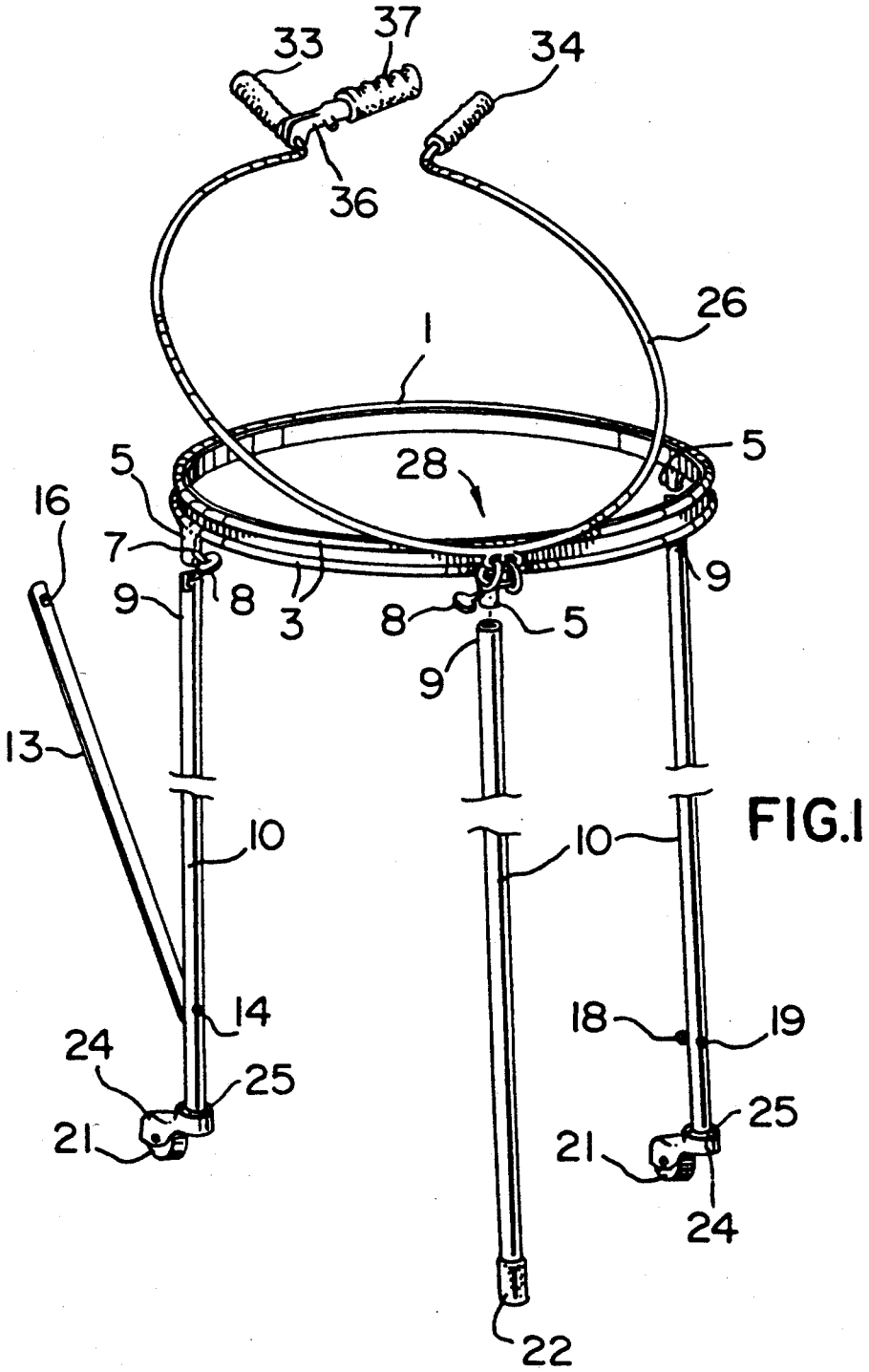
FIG. 1 is an isometric view of a bag holder in accordance with the present invention in the open position.

With reference to FIGS. 1 to 6 of the drawings, the basic bag holder of the present invention includes an annular frame 1 defined by a flat strip of metal 2 with a pair of vertically, spaced apart circular rods 3 connected to the outer surface thereof Three projections 5 extend downwardly from the frame 1 at locations spaced equidistant apart around the periphery of the frame. A bolt 7 with a flat elliptical outer head 8 extends through one side of each projection 5. The head 8 engages the top end 9 of an elongated tubular leg 10 to releasably connect the latter to the frame 1.

Figure 3:
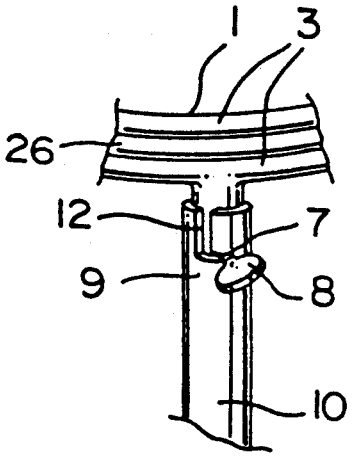
FIG. 3 is an isometric view of the top end of one leg and a portion of the frame of the holder of FIGS. 1 and 2.

As best shown in FIG. 3, each leg 10 includes an L-shaped slot 12 at the top end 9 thereof for receiving the bolt 7. When connecting the leg 10 to the frame 1 the top end 9 of the leg is slid onto the projection 5, the bolt 7 entering the vertical arm of the slot 12, the leg is rotated until the bolt 7 engages the outer end of the horizontal arm of the slot 12, and the bolt 7 is tightened.

Figure 2:
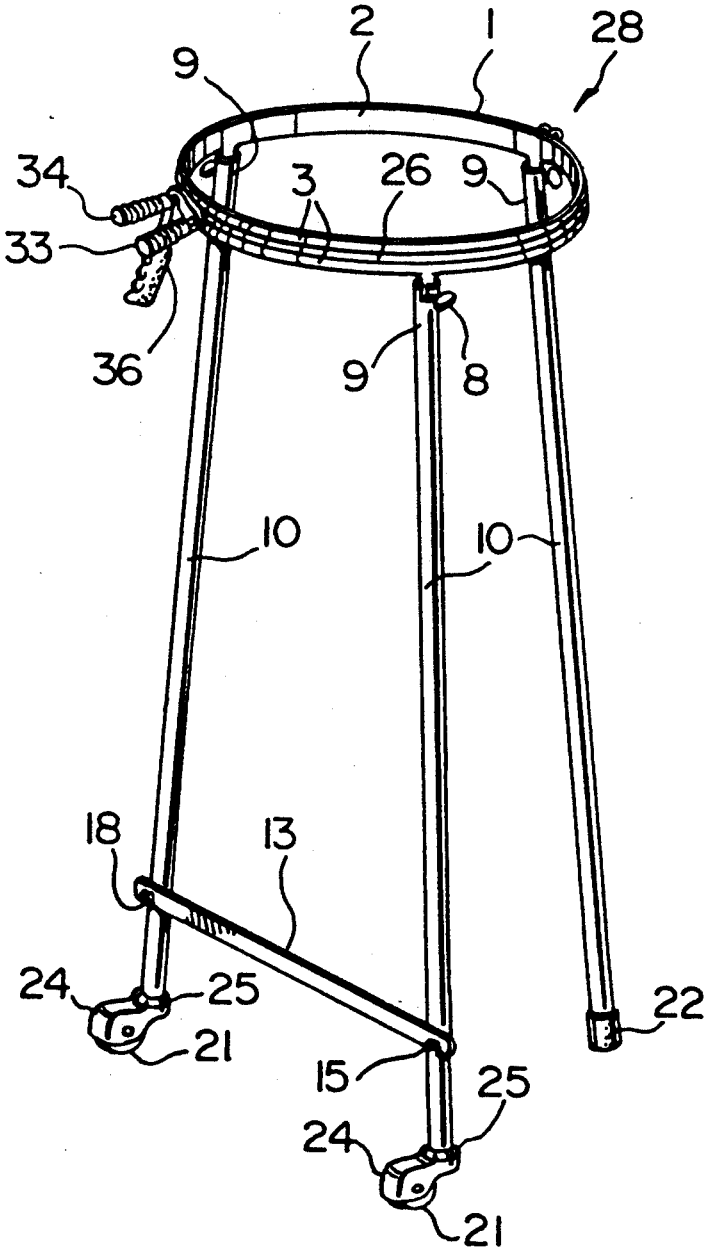
FIG. 2 is an isometric view of the bag holder of FIG. 1 in the closed position.

A crossbar 13 is pivotally connected to one leg 10 by a bolt 14 and a nut 15 (FIG. 2). A notch 16 is provided in the free end of the crossbar 13 for engaging a bolt 18 extending through an adjacent leg 10 to interconnect the legs and thereby stabilize the holder in use. The bolt 18 is held in the leg 10 by a nut 19 (FIG. 1). A wheel 21 is provided on the bottom end of two of the legs 10 and a plastic cap or foot 22 is provided on the remaining leg 10. Each wheel 21 forms part of a caster including a bracket 24, which is pivotally connected to the bottom of a leg 10 by a bearing 25.

Figure 4:
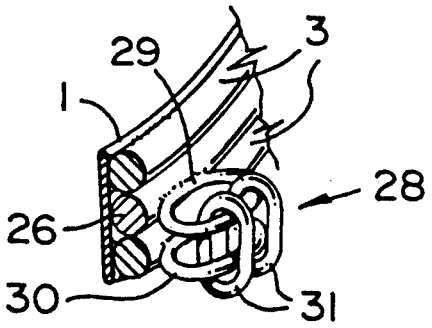
FIG. 4 is an isometric view of a hinge used in the holder of FIGS. 1 and 2.

A bag (not shown) placed in the frame 1 (with the top of the bag overlapping the frame) is retained in the frame by a split ring 26. The ring 26 is defined by a generally circular rod with an opening on one side thereof, i.e. the ring 26 does not define a complete circle. The ring 26 is pivotally connected at its center to one side of the frame 1 by a hinge generally indicated at 28. As best shown in FIG. 4, the hinge 28 is defined by a pair of horizontal, chain link-shaped loops 29 and 30 welded to the ring 26 and to the bottom rod 3, respectively, and a second pair of loops 31 passing through the loops 29 and 30.

Figure 5:
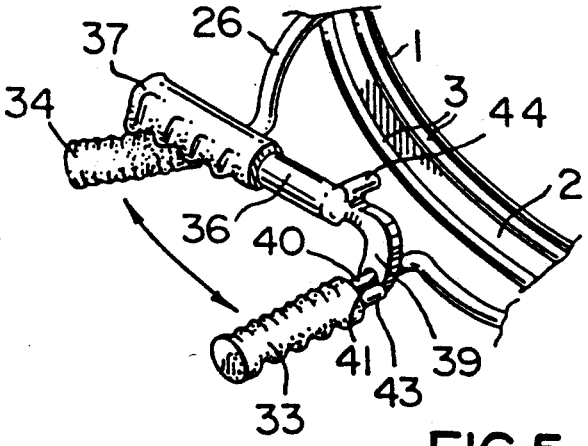
FIGS. 5 and 6 are isometric views of a latch mechanism used in the holder of FIGS. 1 and 2 in the open and closed positions, respectively.
Figure 6:
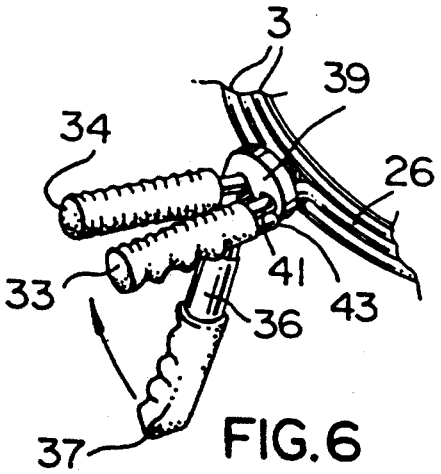

A pair of handles 33 and 34 are provided on the free ends of the ring 26 which are more or less opposite the hinge 28. The handles 33 and 34 are perpendicular to the circle defined by the ring 26 in the closed position. Such handles 33 and 34 are interconnected and pulled together to press the ring 26 against a bag and the frame 1, i.e. to clamp a bag in the frame 1 by a latching lever 36. As best shown in FIGS. 5 and 6, the lever 36 includes an L-shaped body with a rubber hand grip 37 on the outer end thereof. The inner end 39 of the lever 36 is pivotally connected to one free end 40 of the ring 26 by the simple expedient of providing a hole 41 in the lever 36 for receiving such free end 40. The inner, generally V-shaped side of the end 39 defines an arcuate surface for pulling the handles 33 and 34 together (FIG. 6), and for locking the ring 26 in the closed position (FIG. 2). A short rod 43 is connected to the free end 40 of the clamp 26, and a short projection 44 is provided on the inside of the lever 36 for preventing lateral movement of the lever in the closed position (FIG. 6). In such closed position, the rod 43 bears against one side of the lever 36, and the projection 44 bears against the frame 1.

Figure 8:
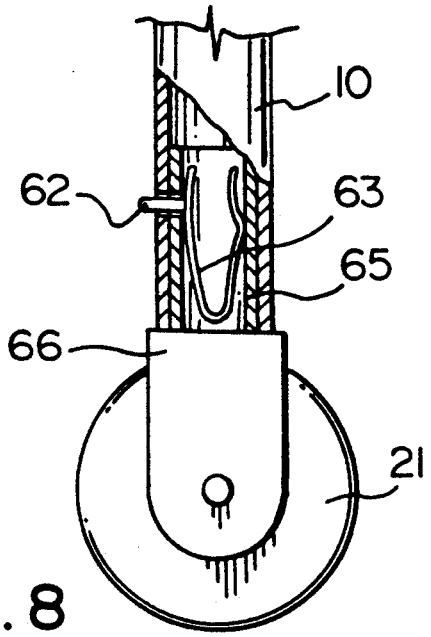
FIG. 8 is a partly sectioned side view of another embodiment of a caster wheel and leg connection.
Figure 7:
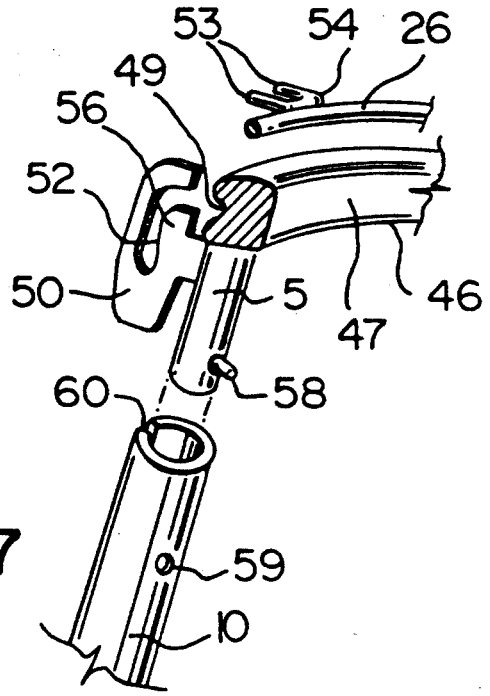
FIG. 7 is an exploded isometric view of a portion of an alternate frame and leg connection.

Different embodiments of the leg to frame connection and hinge will be described with reference to FIGS. 7 to 9. The alternate frame 46 (FIG. 7) includes a one piece annular body 47 with a concave groove 49 extending around the outer periphery thereof for receiving the ring 26. The alternate hinge includes a bracket 50 welded to the projection 5. A generally inverted L-shaped slot 52 is provided in the bracket 50 for receiving one side of the ring 26. The arms 53 of a generally U-shaped guide 54 extend outwardly from the ring 26 on each side of the bracket 50. When the ring 26 is in the groove 49, the arms 53 extend outwardly on either side of an upwardly projecting ear 56 on the bracket 50. When the ring is released and rotated to the open position, the bight of the guide 54 and the ring 26 are slide into the slot 52, the bottom of which supports the ring in the open position.

The leg 10 is connected to the projection 5 by a spring button 58 which extends through a hole 59 in the top end of the leg 10 when the projection 5 is inserted into the leg. A slot 60 is provided in the outer side edge of the top end of the leg 10 for receiving the bracket 50.

A similar button 62 (FIG. 8) connected to a leaf spring 63 is used to connect a caster wheel 21 to the leg 10. The generally V-shaped spring 63 is mounted in a hollow connector rod 65 is mounted in a hollow connector rod 65 which extends upwardly from an inverted U-shaped wheel carrying bracket 66, and the button 62 extends outwardly through the rod 65 and the leg 10.

Figure 9:
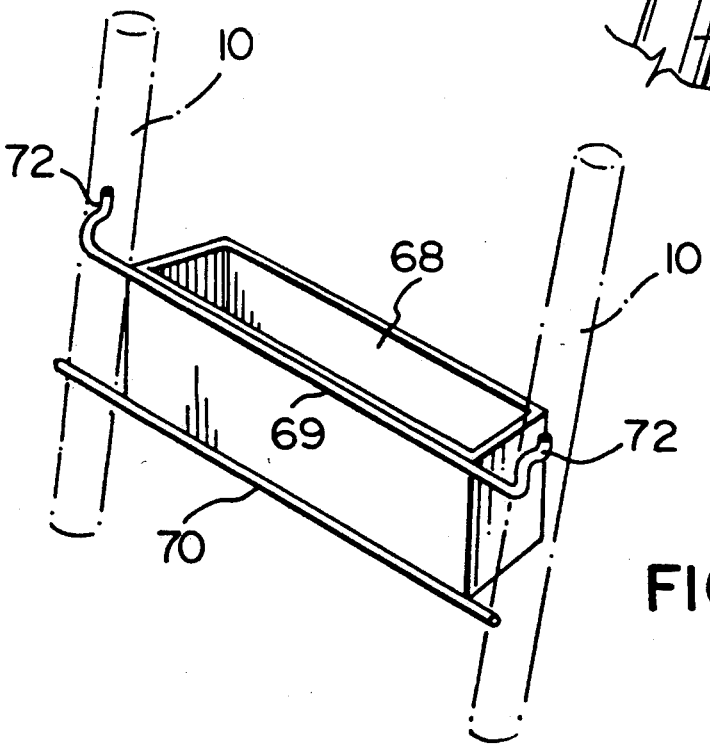
FIG. 9 is an isometric view from above of a bag carrier.

Referring to FIG. 9, a bag carrying container 68 is suspended between two legs 10 by means of a pair of rods 69 and 70. Stepped ends 72 on the rod 69 perpendicular to the main body of such rod are inserted into openings (not shown) in the legs 10. The ends of the bottom rod 70 rest against the legs 10 to retain the container 68 in position.

Figure 10:
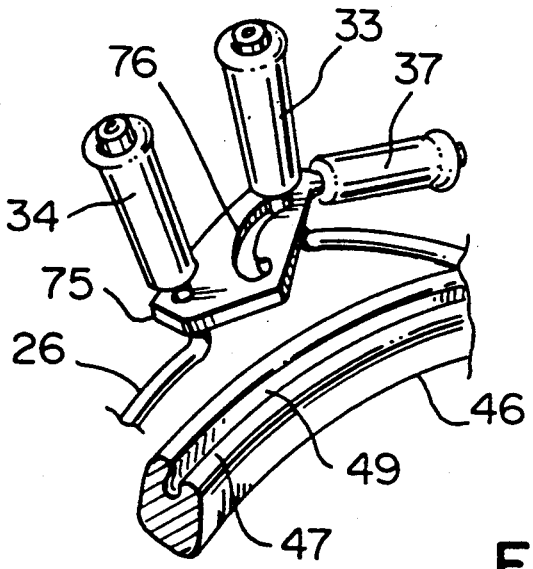
FIGS. 10 and 11 are isometric views from below of another embodiment of the latch mechanism in the open and closed positions, respectively.
Figure 11:
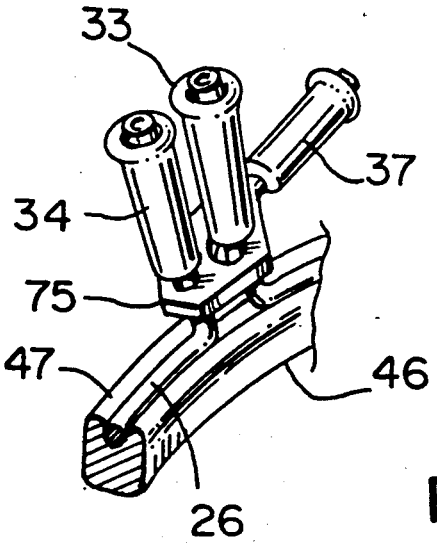

With reference to FIGS. 10 and 11, another embodiment of the latch mechanism includes a latching lever 75 in the form of a generally triangular plate pivotally mounted on one free end of the ring 26. An arcuate slot 76 is provided in the lever 75. In the open position, handles 33 and 34 are spaced a maximum distance apart (FIG. 10). When the ring 26 is rotated into position over the groove 49, the handle 37 and the lever 75 are rotated to the closed position to lock the free ends of the ring 26 together (FIG. 11). The sides of the slot 76 in the lever 75 define arcuate surfaces which perform the same cam locking action as obtained with the lever 36, i.e. which pull the handles 33 and 34 towards each other, and which lock the ring 26 in the closed position.

It will be readily apparent that both embodiments of the invention (FIGS. 1 to 6 and 7 and 8) are readily assembled and collapsed. The ring 26 is easily rotated between the open and closed positions and simple movement of the latching lever 36 results in closing of the ring 26 around the top end of a bag. Normally, the holder is stored in the collapsed condition, the frame 1 forming one separate unit, and the legs, casters and crossbar 13 forming other units which occupy very little space. The holder is readily assembled by inserting the projections 5 into the top ends 9 of the legs 10 and tightening the bolts 7. The crossbar 13 is swung from a storage position parallel to the leg 10 to a use position (FIG. 2) in which the leg engages the bolt 18 on an adjacent leg 10. With the embodiment of the invention shown in FIGS. 7 and 8, the wheels 21 are attached to the bottoms of the legs 10 and the latter are slid onto the projections 5.

When using the assembled holder, with the ring 26 open, a bag (not shown) is inserted into the frame 1 or 46, and the top end of the bag is folded downwardly around the frame. The ring 26 is pivoted downwardly around the frame 1 or 46, the handles 33 and 34 are pulled together and the lever 36 is rotated downwardly to ring the ends of the clamp 26 together (FIG. 6). Releasing of the bag is effected by the same procedure in reverse.

I claim:

1. A holder for a flexible bag comprising annular frame means for supporting the top end of the bag; leg means for holding said frame means in an elevated position; split ring means; hinge means pivotally connecting the center of said ring means to said frame means; handle means extending outwardly from each free end of said ring means for facilitating manual rotation of the ring means around the plane of said frame means between an open position in which only the center of said ring means overlaps one side of the frame means, and a closed position in which the entire ring means overlaps the peripheral outer side edge of said frame means; whereby, with the ring means in the open position, when a bag is placed in said frame means and the top of the bag is folded over the frame means, the ring means can be rotated to the closed position to engage the top of the bag around substantially the entire periphery of said frame means; and first latch means including a substantially triangular lever pivotally connected at one end to one said handle means; and arcuate slot means in said lever for slidably receiving the other said handle means, whereby when the lever is rotated, the other said handle means is moved towards said one handle means to press the ring means against the bag, and to releasably lock both said handle means together.

2. A holder according to claim 1, including projections on said frame means, the top end of each said leg means being hollow for slidably receiving one said projection, and second latch means for releasably connecting each said leg means to one said projection.

3. A holder according to claim 2, wherein said second latch means includes a generally L-shaped slot in the top end of each leg means, and bolt means mounted in said projection for sliding into said slot and releasably engaging said leg means when tightened.

* * * * *